US006981540B2

(12) United States Patent
Deblois

(10) Patent No.: US 6,981,540 B2
(45) Date of Patent: Jan. 3, 2006

(54) PROPER TENT DOOR

(76) Inventor: Armand O. Deblois, 1157 Elm St., W. Springfield, MA (US) 01089-1548

( * ) Notice: Subject to any disclaimer, the term of this patent is extended or adjusted under 35 U.S.C. 154(b) by 84 days.

(21) Appl. No.: 10/637,937

(22) Filed: Aug. 9, 2003

(65) Prior Publication Data

US 2005/0028855 A1 Feb. 10, 2005

(51) Int. Cl.
*E06B 3/36* (2006.01)

(52) U.S. Cl. ..... 160/371; 160/377; 160/381; 52/204.1; 135/117; 16/382; 16/387; 292/202

(58) Field of Classification Search ..... 160/215, 160/371, 377, 381; 135/117; 292/202; 403/381, 403/363; 16/382, 387; 52/204.1
See application file for complete search history.

(56) References Cited

U.S. PATENT DOCUMENTS 2,793,062 A * 5/1957 Fleming ..... 292/57
3,513,862 A * 5/1970 Pohl et al. ..... 135/117
4,231,289 A * 11/1980 Domicent ..... 454/52
4,901,745 A * 2/1990 Rice ..... 135/88.13
5,231,809 A * 8/1993 Benjamino et al. ..... 52/213
6,141,829 A * 11/2000 Boyer ..... 16/224

* cited by examiner

*Primary Examiner*—Blair M. Johnson

(57) ABSTRACT

A tent door which opens and closes in a manner similar to that of a regular house door, yet is in keeping with the requirements for mobility of being light-weight and easily taken apart or reassembled. Such a door being comprised of a fabric panel (54), supported by a rigid frame (22). The frame of this door panel is hinged to a similar frame (20) attached to the perimeter of a cutout opening (56) in the tent wall, against which the door closes. A latch secures the door and allows it to be released for opening by means of a single action which can be performed using just one hand. These are all takedown assemblies connected with manually operated fasteners and employing the lightest or smallest possible components.

3 Claims, 5 Drawing Sheets

PROPER TENT DOOR

BACKGROUND

1. Field of the Invention

This invention relates to tents, specifically to ways of entry and exit.

2. Description of Prior Art

Tent doors are traditonally comprised of either one or several adjoining slits in the tent wall, or a cutout opening in the wall covered by an oversized fabric panel permanently attached along at least one edge. The free edges of both types would be secured by either of two kinds of primitive temporary holding device, cord ties or the toggle and loop fastener.

Cord ties are slow to fasten and the knot can jam or be frozen stiff. The manual dexterity involved make them almost impossible to tie while wearing gloves or mittens, an important factor in extreme cold. The toggle and loop is comprised of an elongated button, or toggle, which is passed through a cord loop that serves as a kind of button hole. As with cord ties, fastening requires the use of both hands and, in both systems, numerous sets must be employed, more or less, depending on the degree of weather tightness desired. The necessity of attaching or releasing each and every fastening in series is slow even in the best of circumstances. Another significant fault is that such a door is never fully insect proof.

The modern approximations of these older means of securing tent flaps, hook and loop tape, side release buckles, and a variety of snap buttons, still present the same operational handicaps of having to use both hands and of needing to be acted on in series. Additionally, all such types of fastening system require a dual matching set, one on either side of the doorway, as the components can only be conveniently manipulated from the side on which the operator is located. This makes it difficult for any other occupant to gain independent access from the side opposite which the entry was last closed.

The zipper now provides a commonly used alternative to these other fastenings. However, the zipper often jams on adjoining fabric, especially so when it must be hurriedly operated. Besides being an annoyance this can cause the zipper to be damaged, as can any acquired debris. In a condition of slackness in the tent wall, two hands are needed to provide a straight track for the slide, one to hold back tension on the fabric while the other pulls on the tab; an operation which might need to be repeated several times on a very long zipper. These problems are compounded by the fact that most applications require two or three sets which must be worked one at a time. Unless operated very slowly, the zipper is noisy and so does not permit a quick undetected escape from any potential threat.

During conditions of extreme cold, in darkness, or an emergency situation such as a tent fire, the degree of manipulation and hand to eye coordination involved in all of these prior methods make them difficult or potentially dangerous. Most users therefore, would find it desirable to have a proper door, one that can be operated quickly and reliably in every condition. A claim further supported by the fact that over the centuries, regular house doors and their casings have been installed in heavy fabric structures such as the yurts of Mongolia, and a variety of large tents used worldwide for long term living. Although such a cumbersome addition is a great benefit and serves well enough in a semi-permanent set up, it is not compatible with the requirements of a tent portable enough for frequent camping/travel.

Rather, it can only be employed when ease of relocation is not a factor and weight or bulk of no great importance. It is not a suitable solution of this long-felt need.

OBJECTS AND ADVANTAGES

Accordingly, I claim the following as my primary object and advantage of this invention: to provide a tent door which can be opened or closed from either side by a single action such as the turn of a handle, the actuation of a lever, or the push of a button. An operation which can deftly be performed, even in the dark, or by a gloved hand when necessary.

Additionally, I claim the following objects and advantages which in combination create an access way superior to other types:

(a) to provide a tent door which, unlike any other type, can quickly be opened to facilitate an emergency escape from the interior;

(b) to provide a tent door which, unlike any other type, can quietly be opened in full control of the operator in order to permit investigation of the outside environment with a minimum of commotion;

(c) to provide a tent door which produces a complete closure effectively barring the entrance of insect pests, a feature lacking in any of the series fastenening systems; and (d) to provide a tent door that possesses all of the previously mentioned qualities yet remains compatible with the tents' need to be reasonably light weight and capable of being efficiently made compact.

Readers will find further information concerning the objects and advantages of this invention from a consideration of the ensuing description of the accompanying drawings.

DRAWING FIGURES

Reference Numerals In Drawings

Figure 1:
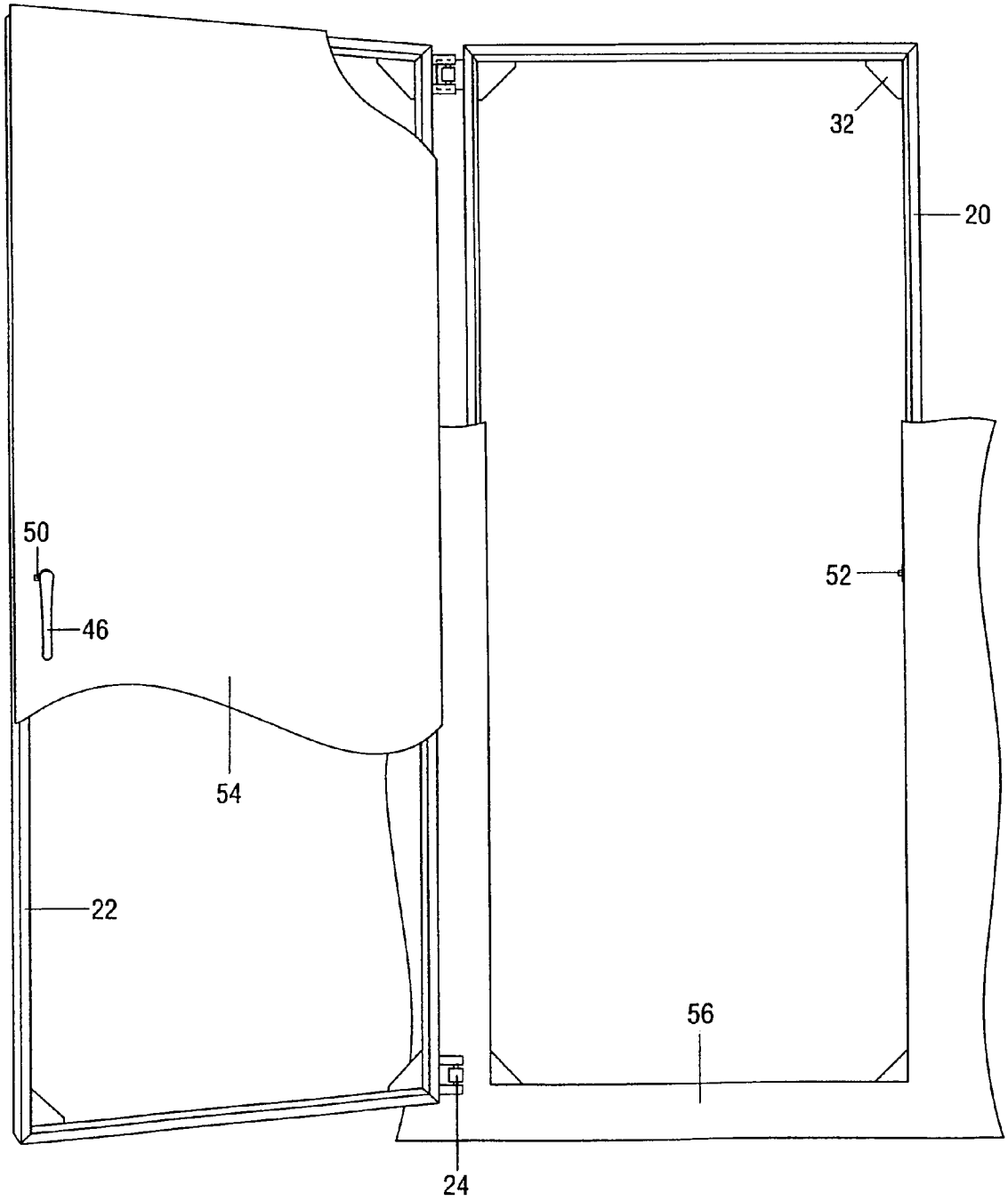
FIG. 1 shows such a tent door from the side of the tent wall to which the door swings open, some of the fabric having been cut away in order to expose the framework.

| | | | |
|---|---|---|---|
| 20 | frame, wall cutout | 22 | frame, door panel |
| 24 | hinge | 26 | connecting arbor |
| 28 | receiver socket | 30 | strut |
| 32 | joint plate, corner splice | 34 | joint plate, straight splice |
| 36 | clearance hole for screw | 38 | threaded hole for screw |
| 40 | detent | 42 | latch mount |
| 44 | door handle, fixed in place | 46 | door handle, removable |

-continued

| Reference Numerals In Drawings | | | |
|---|---|---|---|
| 48 | pivot shaft collar | 50 | revolving latch tab collar |
| 52 | stationary latch tab | 54 | fabric door panel |
| 56 | cutout opening, tent wall fabric | 58 | keeper, fabric sleeve |
| 60 | through hole, tent wall | 62 | through hole, door panel |
| 64 | keeper, fabric pocket | 66 | pivot shaft |
| 68 | anvil bar | 70 | hammer bar |
| 72 | keeper, fabric envelope | 74 | control wire |
| 76 | main actuator bar | 78 | remote actuator bar |

DESCRIPTION

Figure 5:
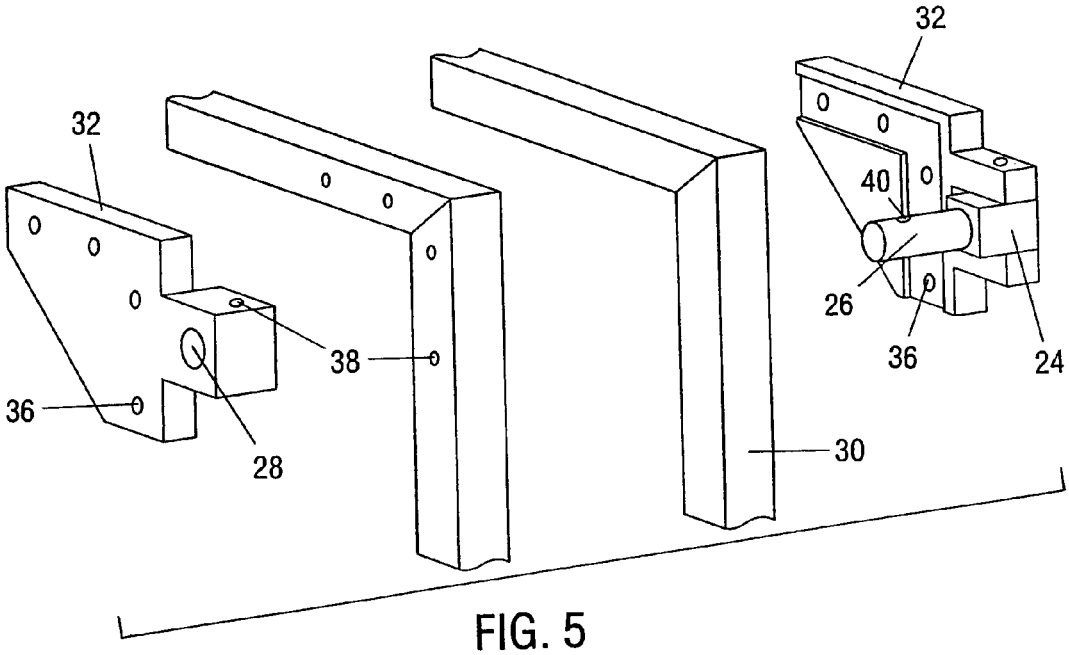
FIG. 5 is an exploded view of the hinge mechanism and cut away sections of the frames at corner splices.

Two opposing frameworks, the size and shape of the desired doorway, are designated wall cutout frame 20 and door panel frame 22. A cutout opening 56 in a tent wall is bordered by frame 20. Frame 22 supports a fabric door panel 54 somewhat larger than cutout 56. The frames are joined together and can be moved angling away from each other by a special hinged connection device which passes through the tent wall. An exploded view of this device is illustrated in FIG. 5. It is comprised of two major components: (1) a hinge 24 and connecting arbor 26, and (2) a receiver socket 28. The first component is attached to frame 22; the second component is attached to frame 20. With the two components mated, arbor 26 extends through a hole 60 in the tent wall, and into socket 28. A manually operated screw (not shown) installed in a threaded hole 38 in the side of socket 28 engages a detent 40 on arbor 26 locking the unit together. This particular functional design—having the frames on opposite sides of the tent wall—makes it possible to press the edge of the fabric panel directly against the fabric surrounding the cutout in order to effect a complete closure of the entry.

Frames 20 and 22 are takedown assemblies. Each of several elongated frame members is a hollow strut 30. These struts are connected to each other by two types of attachment fixture designated corner splice joint plate 32 and straight splice joint plate 34. Both types of joint plate are precisely grooved to accept an end each of two struts in order to provide proper alignment for a closely matching surface between the opposing frameworks. Attachment is by manually operated screws (not shown) which pass through clearance holes 36 in a joint plate into threaded holes 38 in the end of a strut. These particular threaded holes are provided by special inserts (not shown) for use in thin-walled applications.

Figure 2:
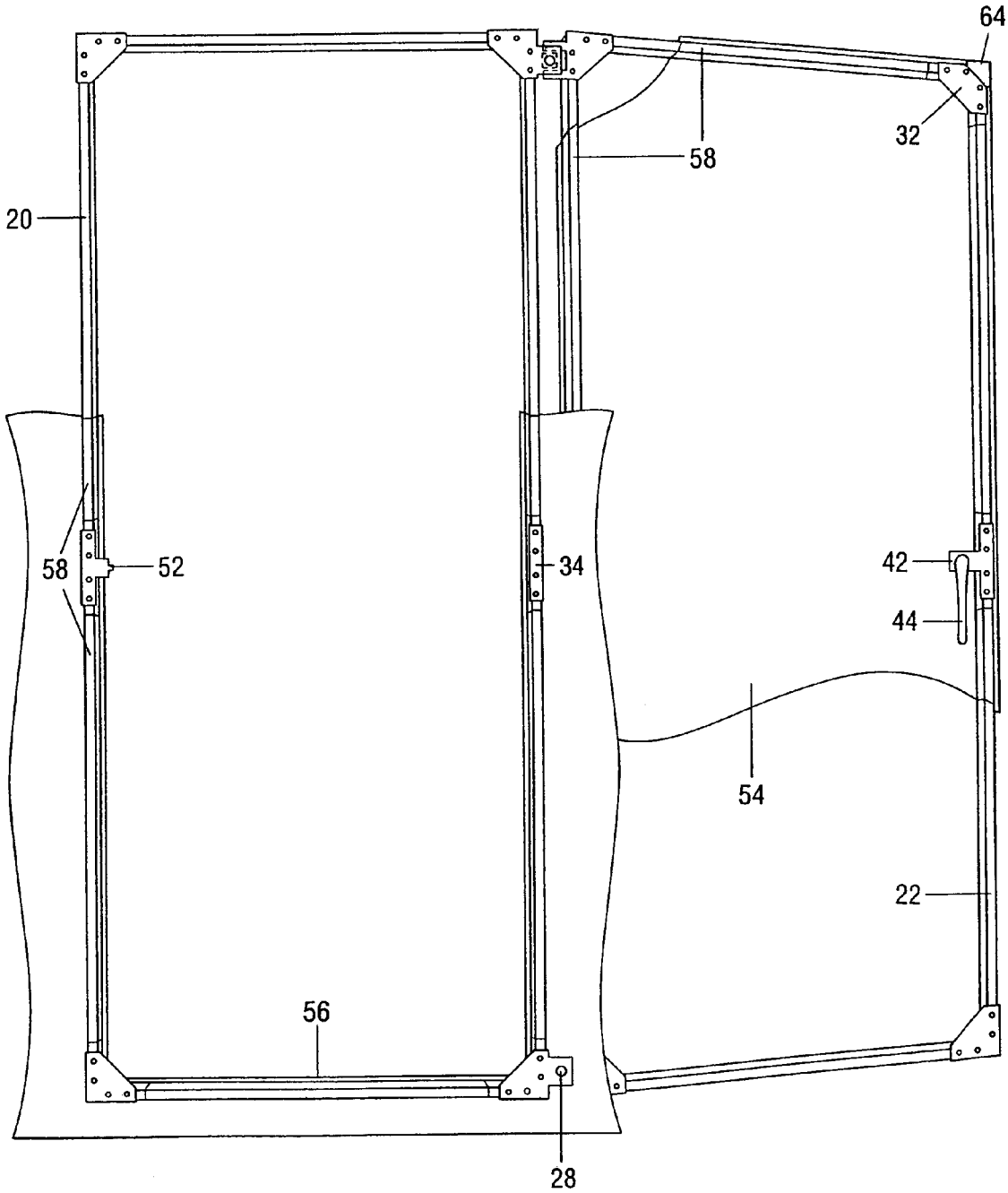
FIG. 2 shows the doorway viewed from the side opposite that seen in FIG. 1 showing how the frames and the fabric are held together.
Figure 3:
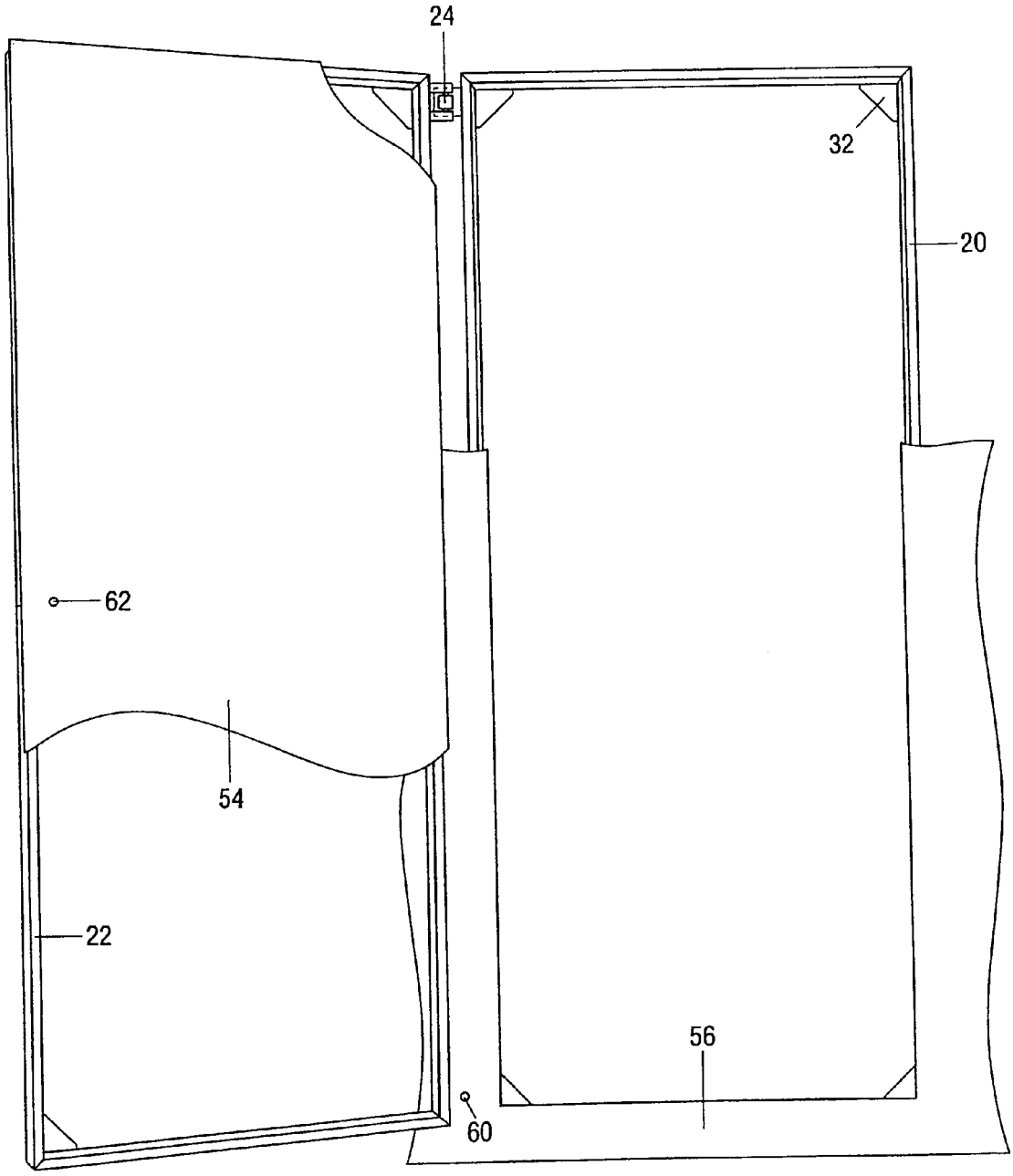
FIG. 3 is the same view as in FIG. 1 except that both the lower hinge and the latch have been omitted to show the through holes in the fabric components.

Frame 20 is held to in place against the tent wall by keepers in the form of fabric sleeves 58 at the perimeter of the cutout. The fabric panel attaches to frame 22 by the same kind of keepers and also at each corner by a keeper in the form of a fabric pocket 64. As can be seen in FIG. 2, the keeper sleeves encase the frame struts continuously along their length except where the various joint plates attach.

Figure 4:
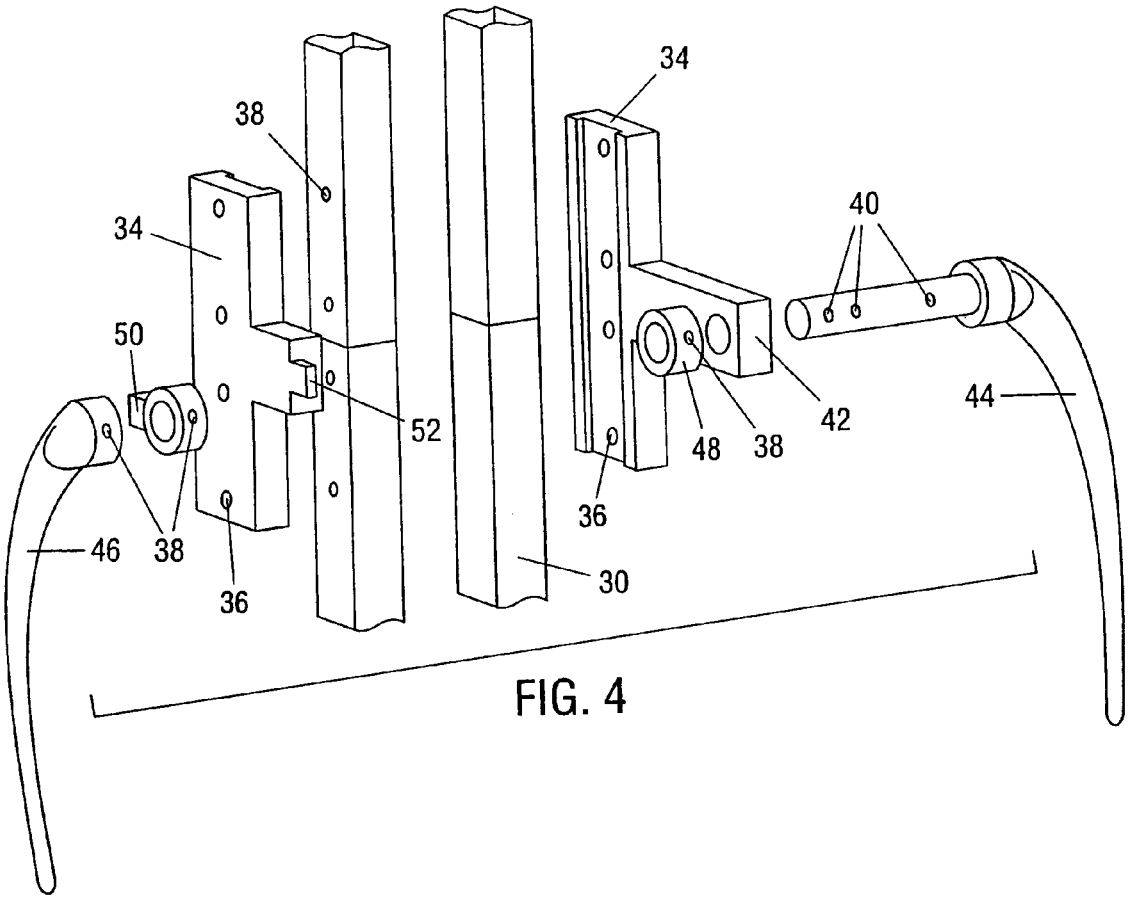
FIG. 4 is an exploded view of the basic form of a one quarter turn latch mechanism and cut away sections of the frames at straight splices.

Those edges of frames 20 and 22 opposite the hinged edges are temporarily held together (or can be released from each other) by a proper door latch, one type of which is illustrated in FIG. 4. This is a two part mechanism, the first part being comprised of several components: (1) a latch mount 42, which carries the movable part of the mechanism and is attached to frame 22; (2) a pivot shaft 66 incorporating a permanently attached or fixed door handle 44, the shaft of which extends through a closely fitting hole in mount 42; (3) a pivot shaft collar 48 which locks in place by a screw (not shown) which engages a corresponding detent 40 on shaft 66. Being locked in this position the collar prevents back and forth motion of the shaft while still permitting it to turn. The assembly, as thus far described, never needs to be taken apart except for cleaning and oiling. With the unit in place on frame 22 the free end of shaft 66 extends through a hole 62 in fabric panel 54. Here on the other side of the panel are positioned (at final assembly) the detachable elements: (4) a revolving latch tab collar 50; and (5) a removable door handle 46. Each is held in place by a manually operated screw (not shown) which engages a coresponding detent 40 on shaft 66. The second part of the door latch mechanism is a single element; a stationary latch tab 52, which mounts to frame 20 in a position opposite the first part of the mechanism on frame 22.

Figure 6:
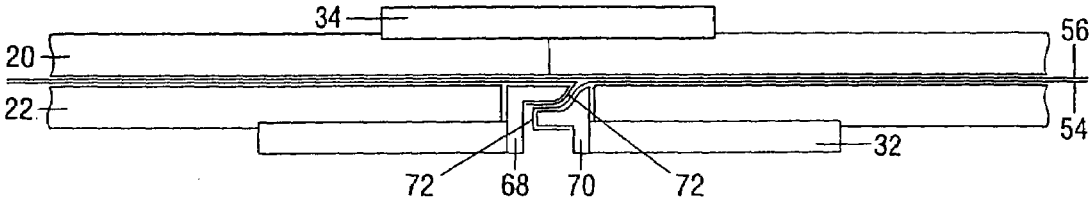
FIG. 6 is a top view of a two door entryway illustrating the way a fabric to fabric closure is effected by an overlap at the meeting of the doors.
Figure 7:
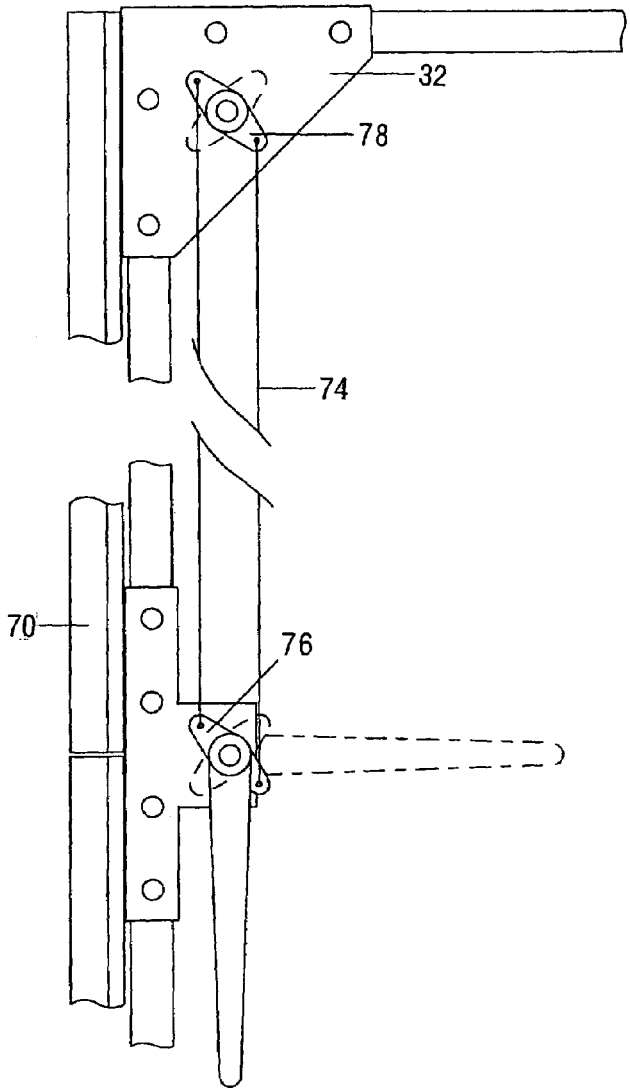
FIG. 7 illustrates a method used to operate a latch located at a distance from the handle.

The design modifications required for a double door version of such an entryway are illustrated in FIG. 6 and FIG. 7. These modifications are due to the fact that there is no structural member at the centerline of the wall frame to either press against for closure, or attach to for latching.

FIG. 6 is a top view and shows the end or cross sectional shape of two types of specially shaped angle bar stock which extend along the length of the meeting edges of the doors. These are designated anvil bar 68 and hammer bar 70. The working arm of each bar stock member is inserted into a keeper in the form of a fabric envelope 72 at the edge of a fabric panel, also seen here on end, from a top view. The overlapping arms of the bars have the fabric edges of both panels pressed together between them, thereby producing a closure along the centerline of the doorway.

FIG. 7 is a front view of a method of remotely operating a latch. The view is segmented due to space requirements and for the same reason shows only the upper part of what is in practice a two latch device. In this case the latch handle remains in the normal position but each latch is removed to an end of the door in order to be in proximity to, and engage an opposing member of the wall frame. The latch is remotely operated by control wires 74 running from a main actuator bar 76 at the latch handle to a remote actuator bar 78 at the latch. One door—requiring no latch—is held in place by the other door which closes over it and latches shut. The manner of employing two short lengths of angle bar stock for convenient packing is also seen in this view; each section being attached to both a corner joint plate 32 and the half part of a straight joint plate 34. Manually operated screws (not shown) fasten bar stock to joint plates.

OPERATION

This new kind of covered access way is an efficient apparatus in keeping with the essence of a collapsible fabric structure; one which can quickly be put together or taken apart by hand without the use of tools. Prior to assembly the fabric door panel is completely separate from the rest of the tent. First, all of the struts are slid longways into the sleeves around the perimeters of both the fabric panel and the cutout opening. Next, all joint plates type 32 and type 34 are fastened in place; some of these joint plates possesing elements of the hinges and latch. The fabric pockets at the corners of panel 54 are then pulled in place over the ends of the corner plates on frame 22. At this point the frameworks are rigid forms serving to firmly support the fabric door panel and the cutout opening in the tent wall. The door is now installed on the tent by inserting the connecting arbors of the hinges through the holes in the tent wall and into the receiver sockets on the other side. Finally, the two components of both hinge mechanisms are locked together, thus securing the door to the tent. The entry can now be closed or reopened by giving either latch handle a one quarter turn, one way or the other.

Frame 20 which is firmly attached to a large area on one side of the tent wall solidly supports and distributes the stress of the swung open door on the opposite side. Frame 22 provides full control of fabric panel 54 so that it can effectively be moved out of the way, thereby conveniently producing an unobstructed passage; an important factor which permits equipment to be brought in or out of the tent unhindered. And of greatest functional significance, the hinged/opposing frames combination makes it possible to employ any type of proper latch capable of gently releasing the door with a single action; a valuable feature never before available in a tent designed for ease of mobility.

SUMMARY, RAMIFICATIONS, AND SCOPE

Accordingly, the reader will see that this new development in a tent door is suitable for universal application in the field of portable and easily assembled fabric structures.

This type of apparatus can be applied to the entry of any kind of collapsible fabric structure other than a tent, such as a temporary room divider for example.

The sleeping bag is another type of portable fabric enclosure which greatly benefits from this kind of closure. When such a device is used in place of the zipper a sleeping bag is much easier to get in or out of, greatly reducing any sense of entrapment In this greatly simplified application only two opposing elongated structural members are required. These opposing strut bars are connected at one end by a single hinge of this type and at the other by a magnetic catch. Although not strictly necessary, a different kind of hinge in the form of a ball joint permits a universally angling and swiveling motion of the upper bar in relation to the lower. In use the top of the bag can be lifted off the occupant almost as easily as a blanket.

The struts are of tempered aluminum or any material of similar or better weight to strength ratio. While the struts depicted in the illustrations are square in cross section, a somewhat lighter version of such a doorway can be produced by using round tubing. And if it is desirable to have more contact surface than that afforded by a round shape, one having either a triangular or a "D" shaped cross section can be employed. The cross sectional dimension and wall thickness of the struts depends on the overall size of the doorway as well as choice of material. A small door for a one or two person tent employs struts the size of arrow shafts, the various other hardware being correspondingly diminutive in size.

As an alternative to ferrules, joint plates are used to provide more stable splices thus producing accurate alignment and mating of the opposing frameworks; a factor especially critical when employing struts round in cross section which provide a minimum of contact area Round or triangular struts require joint plates grooved with either semi-round or "V" shaped channels suitable to these forms. The plates are also convenient points of attachment for components of the hinges or latch. A joint plate grooved, in part, with each end having a different depth is used to splice struts of different cross sectional dimension. This technique can permit the use of a stronger section at the more flexible middle of a long run. In another modification a joint plate grooved, in part, with each end at a shallow angle is used to put the angled approximation of a slight arch in a long frame member where the door latches. This is of advantage when small or extremely thin-walled struts are employed for lightness. These can tend to be too weak to keep the ends of the door firmly closed. In this case, when the arch is compressed by the latching of the door it tends to press more firmly out at the ends.

Such a doorway can be of any other overall shape than the rectangular one depicted, such as a triangle for example.

An opposing pair of soft rubber gaskets glued to the perimeters of both the door panel and the cutout opening can be used to produce a rain proof seal. This creates a door which can be used even in an application unsheltered from above.

The door latch can be any kind of single action hold or release device other than the type illustrated, such as one actuated by a lever or a push button for example. Even a magnetic catch can be employed in any application intended for frequent use and which does not require a great deal of security. The two halves of any type of latch can be made to register in proper relation to each other by the use of a conical protrusion on one which seats in a conical depression on the other when the latch is closed.

In place of screws, quicker operating devices can be employed such as quarter turn cam locking fasteners or push button spring pins for example.

With a single action performed by one hand, the door is free to be opened from either side. Closing is positive, making full contact regardless of any slackness or distortion in the tent itself. The panel is stable and so can be opened in complete control of the operator, up to one hundred eighty degrees. The framework breaks down into pieces that can be tightly packed. In relation to the entire tent package, the hardware involved does not constitute a significant amount of added bulk or weight, especially in light of the many important advantages it provides. In totality this proper door—in keeping with the requirements of a tent suitable for nomadic camping—presents an apt solution of this long-felt need.

Although the description above contains many specificities, these should not be construed as limiting the scope of the invention but as merely providing illustrations of some of the presently preferred embodiments of this invention.

Thus, the scope of the invention should be determined by the appended claims and their legal equivalents rather than by the examples given.

I claim:

1. A door and entryway in a wall of a tent comprising:

a door and tent wall composed of a flexible sheet material;

a cutout opening in the tent wall incorporating a configuration of said sheet material at the perimeter of the cutout opening into a plurality of sleeves formed in the sheet material;

a stationary support frame installed in the sleeves;

the door comprising a movable support frame joined in opposition to the stationary support frame by at least one hinge, said hinge comprising extension means for remote connecting through a hole in the flexible material along one edge of the cutout opening;

the door further comprising a piece of the sheet material of the same shape and larger than said cutout opening and incorporating a configuration of the piece of flexible material at the perimeter thereof into a plurality of sleeves, the piece of flexible material mounted to the movable frame by it's sleeves;

the stationary support frame and the movable support frame each comprising releasably connected hollow strut sections, attachment fixtures releasably connecting the sections of each respective frame, each respective sleeve having openings on one side thereof, the attachment fixtures directly fixed to the sections at the openings, thereby forming rigid frames;

whereby the two frames when installed in the flexible sheet material and the sections thereof are closely parallel to each other, have supported and positioned between them a continuous strip of the perimeter of said flexible material of the door against the continuous strip of flexible material of said cutout opening, thus effecting a closure of said tent entry way.

2. The door and entryway of claim 1 further including one of the attachment fixtures at each joining of the sections of said frames, the attachment fixtures comprising means for connecting an end of each of two of said sections.

3. The door and entryway of claim 1 wherein each sleeve is permanently formed.

* * * * *